US006312017B1

(12) United States Patent
Hardwick et al.

(10) Patent No.: US 6,312,017 B1
(45) Date of Patent: Nov. 6, 2001

(54) SKATE GUARD WITH SHARPENER

(75) Inventors: Rick William Hardwick, Coutice; Randy M. Pollard; John William Dymond, both of Bowmanville, all of (CA)

(73) Assignee: Jarr Canada, Bowmanville (CA)

( * ) Notice: Subject to any disclaimer, the term of this patent is extended or adjusted under 35 U.S.C. 154(b) by 0 days.

(21) Appl. No.: 09/543,579

(22) Filed: Apr. 5, 2000

(51) Int. Cl.[7] ..... A63C 3/99
(52) U.S. Cl. ..... 280/825; 280/811; 451/558
(58) Field of Search ..... 280/825, 811, 280/11.18; 76/83; 451/558

(56) References Cited

U.S. PATENT DOCUMENTS

| | | | | |
|---|---|---|---|---|
| D. 248,210 | * | 6/1978 | Dill | D8/91 |
| D. 394,196 | * | 5/1998 | Richardson | D8/90 |
| 1,925,697 | * | 9/1933 | Johnson | 280/825 |
| 4,264,090 | * | 4/1981 | Davies | 280/825 |
| 4,392,674 | | 7/1983 | Evon | 280/825 |
| 4,673,196 | | 6/1987 | Hall | 280/825 |
| 5,167,170 | | 12/1992 | Croteau | 76/83 |
| 5,445,050 | | 8/1995 | Owens | 76/83 |
| 5,499,556 | | 3/1996 | Exner et al. | 76/83 |
| 5,569,064 | * | 10/1996 | Gleadall | 451/558 |
| 5,704,829 | * | 1/1998 | Long | 451/558 |
| 5,916,018 | | 6/1999 | Watt | 457/555 |
| 5,941,568 | | 8/1999 | White, II | 280/825 |
| 6,030,283 | * | 2/2000 | Anderson | 451/558 |

FOREIGN PATENT DOCUMENTS

| | | | |
|---|---|---|---|
| 587881 | 12/1959 | (CA) | 57/29 |
| 666685 | 7/1963 | (CA) | 57/29 |
| 1066731 | 11/1979 | (CA) | 273/12 |
| 2079191 | 3/1994 | (CA) | B24B/9/04 |
| 2105328 | 3/1995 | (CA) | B21K/17/00 |

* cited by examiner

*Primary Examiner*—J. J. Swann
*Assistant Examiner*—James S. McClellan
(74) *Attorney, Agent, or Firm*—Gowling Lafleur Henderson LLP

(57) ABSTRACT

An ice skate guard with a sharpener. The ice skate guard has a housing with a channel and a sharpener. The channel extends along the housing, and receives a skate blade. The sharpener is mounted in the housing and extends into the channel. When a skate blade is drawn through the channel the sharpener engages with the blade and sharpens the blade.

16 Claims, 3 Drawing Sheets

SKATE GUARD WITH SHARPENER

FIELD OF THE INVENTION

The present invention relates to ice skate guards. In particular, the present invention relates to an ice skate guard with a sharpener.

BACKGROUND OF THE INVENTION

Skate blades may require frequent sharpening, depending on the frequency of use. Skate blades can become dull or damaged not only with normal use but also if they come into contact with a hard surface, such as a concrete floor or a rock.

Many skate sharpening devices are known. Traditional shop skate sharpening utilises a horizontally disposed grinding wheel. The skate is mounted in a clamp with the blade horizontal. The center of the blade is placed at the same elevation as the center of the wheel and the blade is run along the grinding wheel for sharpening. These sharpeners are not portable and require the skate owner to take the skates to the shop, which is inconvenient and can prove costly if the skates require frequent sharpening.

U.S. Pat. No. 5,167,170 discloses an ice skate support sharpening apparatus. The apparatus is a bag that contains a central cavity with a left and a right flap. Within each flap is an ice skate support member with a "v" shaped groove, for receiving the ice skate blade, containing a sharpening stone. The apparatus can be adapted to contain fluid reservoirs that transport a fluid, such as a lubricant oil, to the "v" shaped grooves. The apparatus can be cumbersome for a user to transport as it adds additional "luggage" to the user's equipment. The apparatus requires the user to pass the skate through an opening and place it in the "v" shaped groove within the enclosure of the bag, which may prove awkward for the user.

Portable hand-held sharpeners are known. These devices usually have an elongated slot, for receiving the skate blade, with honing stones for sharpening the blade.

U.S. Pat. No. 5,499,556 discloses a portable ice skate blade sharpener with two elongated slots. A first slot contains a honing stone at the bottom of the slot for sharpening the blade and the a second slot contains opposing honing stones along the side walls for deburring the skate blade. The process requires two steps for sharpening and deburring the blade which may be time consuming for the user. The device may also be lost amongst equipment or left behind after use.

Skate guards are known. Traditional skate guards are used to protect the skate blade when not in use and to allow the user to walk in the skate on a non-ice surface.

U.S. Pat. No. 4,673,196 discloses a guard for skate, made from a flexible material, for allowing the user to walk on a non-ice surface. The guard has a body that contains a groove that has fins extending from the interior walls. When the blade is placed in the groove the fins are deflected downwards securing the blade in place. The bottom side of the body is concave downwards and, when pressure is applied by the user, exerts a force that narrows the top of the groove providing further pressure on the blade to secure it in position.

U.S. Pat. No. 5,941,568 discloses a skate guard that has a guard bar with a channel and a heel block. The channel narrows at the toe end to exert a pressure that holds the skate blade securely. The blade is inserted into the guard with the heel portion first followed by the toe, a spring exerts tension on the guard to hold the blade in place. When the blade is in place the blade's runner edge is held with minimum contact with the guard in order to protect the blade edge.

These skate guards merely provide protection for the skate blade in between required sharpenings. It is therefore desirable to provide an ice skate guard that contains a sharpening device. It is further desirable to provide a skate guard that contains a sharpening device that allows the user to sharpen the blade of the skate whilst protecting the blade and allowing the user to walk on a non-ice surface.

SUMMARY OF THE INVENTION

According to the present invention, there is provided an ice skate guard having a housing that includes a channel and a sharpener. The channel extends along the housing and receives a skate blade. The sharpener is mounted to the housing and extends into the channel to engage the skate blade as the skate blade is drawn through the channel.

According to one embodiment of the present invention the sharpener has two opposing stones.

According to a further embodiment of the present invention the ice skate guard has an actuator that is connected to the sharpener for urging the stones against the skate blade.

According to a further embodiment of the present invention the actuator has two opposing push buttons.

According to a further embodiment of the present invention the ice skate guard has a resilient biasing means that acts between the housing and the sharpener.

According to a further embodiment of the present invention the resilient biasing means has two opposing springs.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
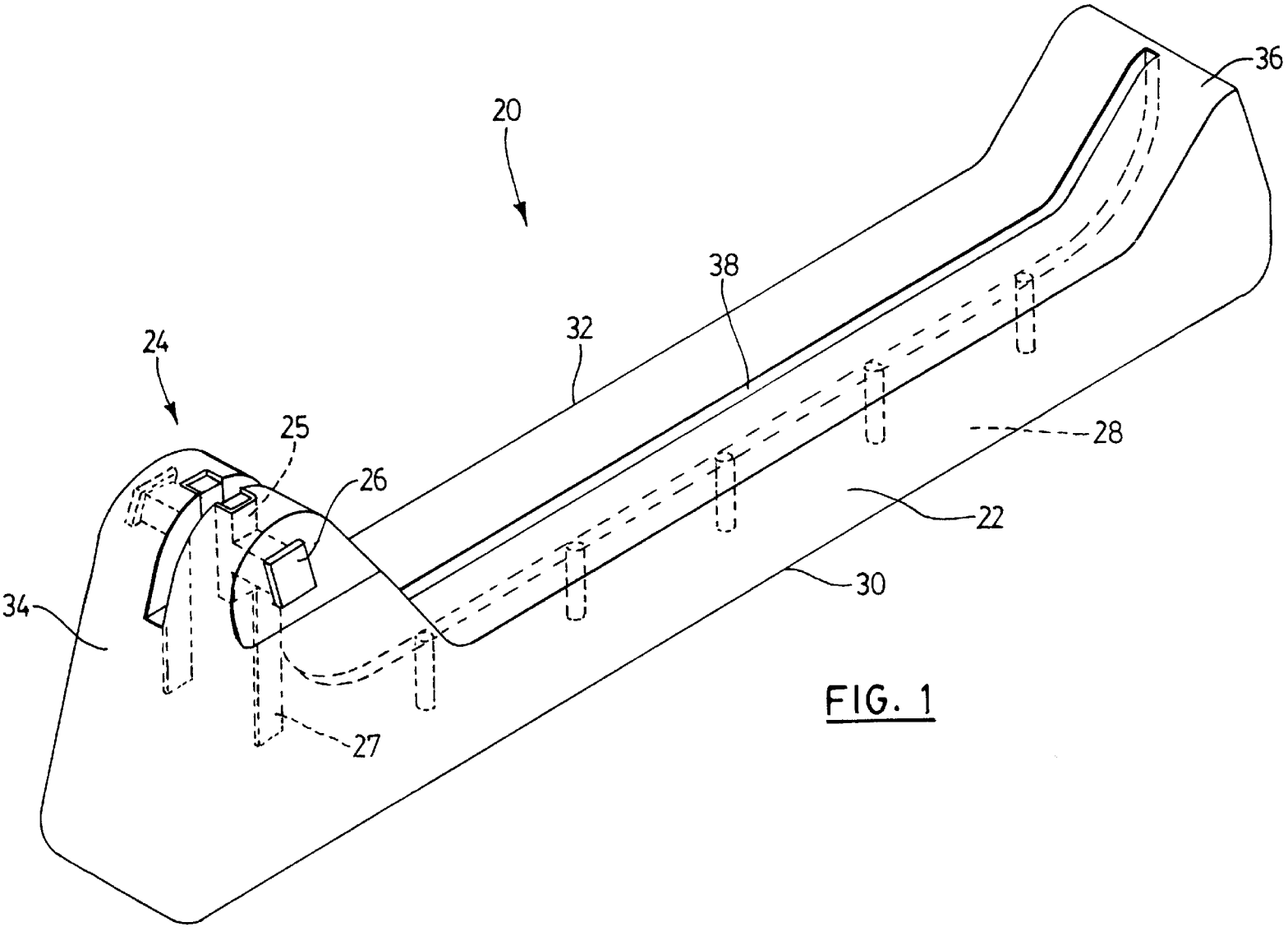
FIG. 1 is a perspective view illustrating a skate guard according to the present invention.

Referring now to FIG. 1, an ice skate guard is indicated generally by reference 20. In a presently preferred embodiment the ice skate guard 20 includes a housing 22 and a sharpener 24.

In the presently preferred embodiment the housing 22 has a substantially rectangular base 28, opposed longitudinal side walls 30, 32 and end portions 34, 36. The end portion 34 protrudes from the base 28 and is shaped for accommodating the toe portion of an ice skate blade. The end portion 34 contains the sharpener 24. The end portion 36 protrudes from the base 28, at the opposing end from the end portion 34, and is shaped for accommodating the heel portion of an ice skate blade. The housing 22 has a channel 38 for receiving an ice skate blade 40. The Channel 38 has a width corresponding to the thickness of the ice skate blade 40, and a length corresponding to the length of the ice skate blade 40. The Channel 38 may be generally continuous through the end portion 34.

Figure 3:
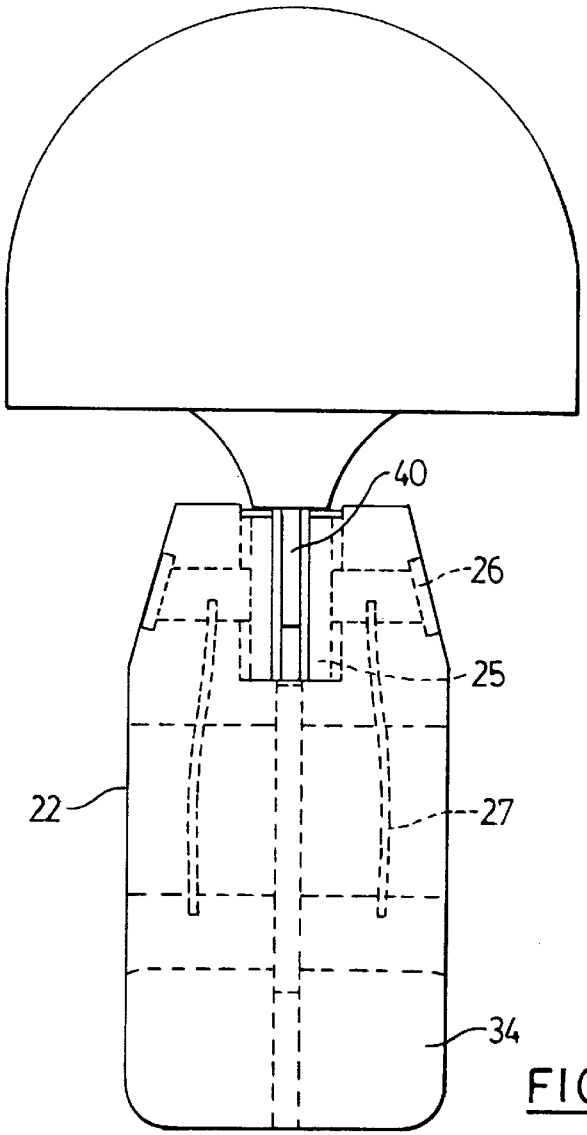
FIG. 3 is a view corresponding to FIG. 2 but illustrating a sharpening configuration; and, FIG. 4 is a perspective view illustrating an ice skate being placed in the skate guard.

The Sharpener 24 includes a pair of opposed sharpening stones 25 disposed on either side of the Channel 38. The stones 25 are moveable toward each other into a sharpening configuration engaging the sides of the skate blade 40 as illustrated in FIG. 3. Push buttons 26 extending through the sharpener 24 are illustrated as a suitable actuator for moving the stones 25 into the sharpening configuration.

Figure 2:
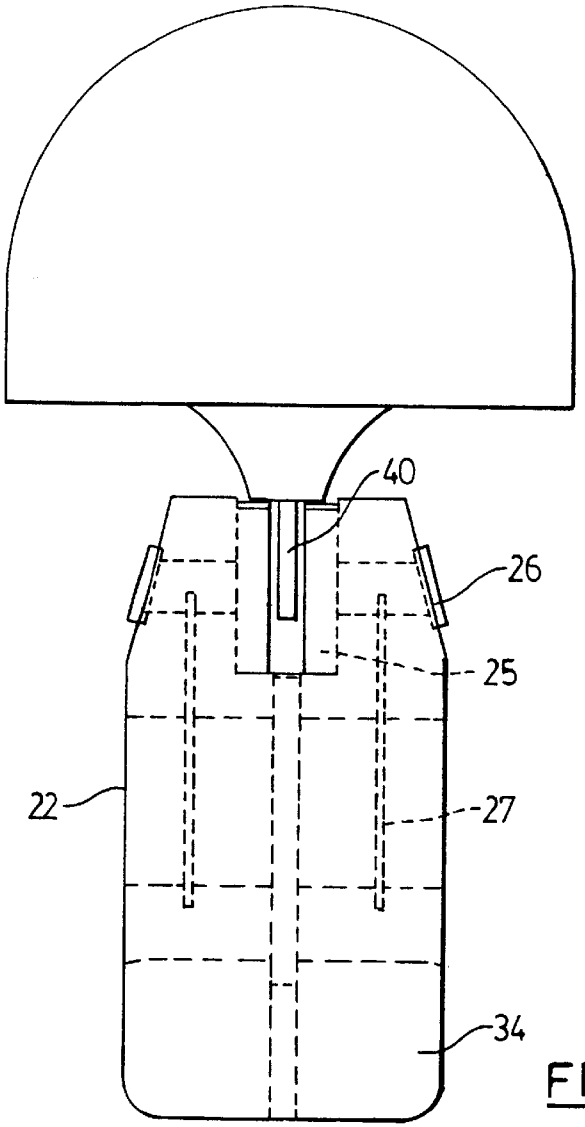
FIG. 2 is a front view illustrating the front of an ice skate in a sharpening portion of a skate guard according to the present invention with the sharpening portion in a non-sharpening configuration.

The stones 25 may be moveable away from each other and the blade 40 into a non-sharpening configuration, as illustrated in FIG. 2, by the action of a biasing means such as leaf springs 27. The leaf springs 27 are mounted to the housing 22 and are resiliently deformed, as shown in FIG. 3 by the action of the push buttons 26. Upon release of the push buttons 26, leaf springs 27 restore themselves and urge the stones 25 out of engagement with the blade 40. The leaf springs 27 may advantageously be a SAE1050 grade spring steel clip.

The skate blade 40 can be placed in a sharpening positioning when being placed in skate guard 20 and/or when being removed from the skate guard 20 or as frequently as the user requires. To engage the sharpener 24 in the sharpening position the user simply applies a force to the actuator 26 which applies pressure on the opposing stones 25 pressing them against the skate blade 40 and runs the skate blade 40 along the stones 25.

Figure 4:
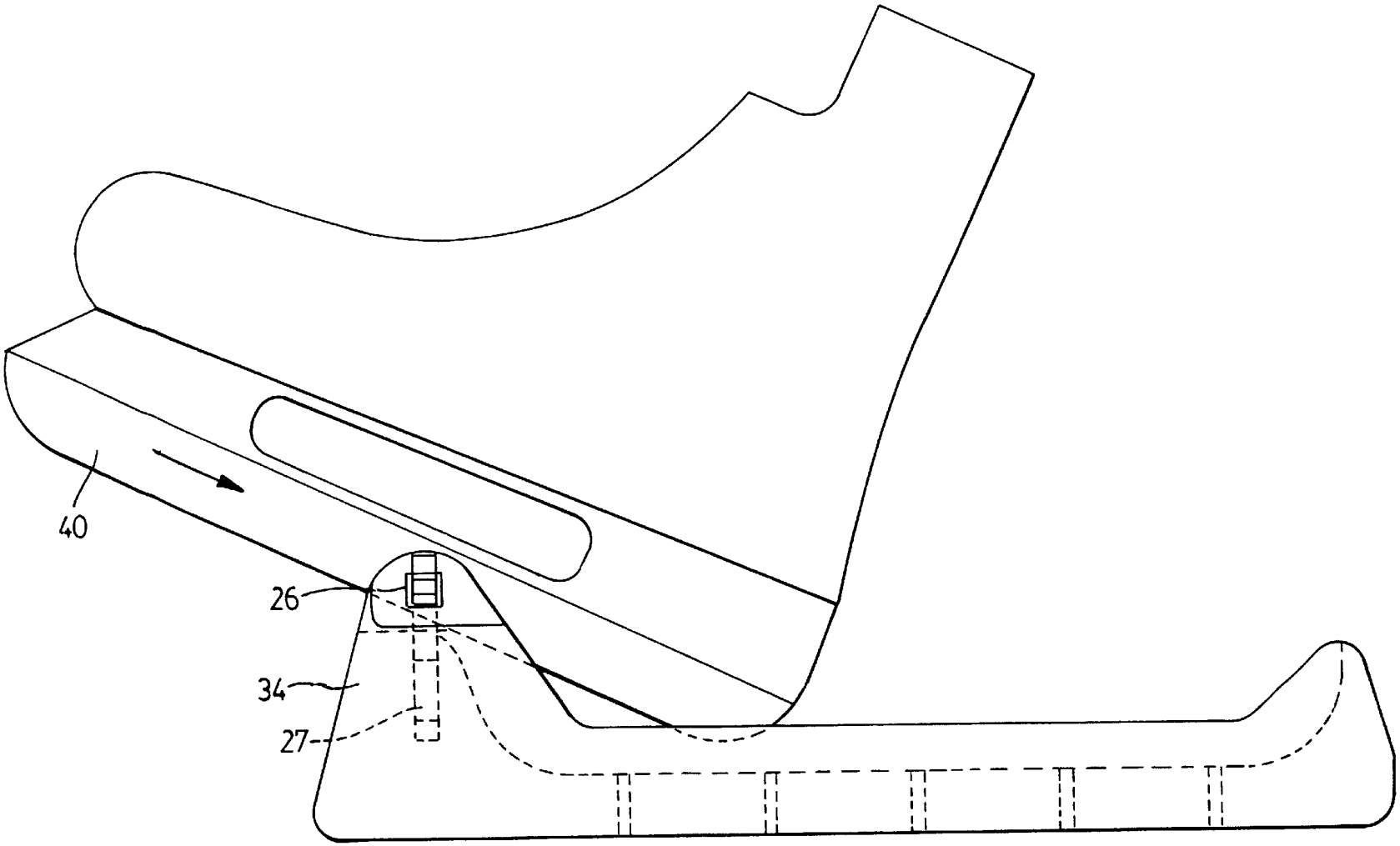

Referring now to FIG. 4, the skate blade 40 is illustrated in the process of being sharpened. The skate blade 40 is drawn through the end portion 34 to be received by the channel 38. The user applies pressure to the actuator 26 which applies pressure to the opposing stones 25 and presses them against the skate blade 40. The pressure is applied continuously as the skate blade 40 is drawn through the end portion 34 to be received by channel 38. Upon completion, the user releases the pressure applied to the actuator 26 and the resilient biasing means 27 returns the opposing stones to the non-sharpening position.

It will be appreciated that variations may be possible to the presently preferred embodiment, while staying within the scope of the present invention, for example: another resilient biasing means such as coil springs might be used in lieu of the leaf springs 27; one of the stones 25 may be fixed and the action of the opposite stone 25 relied upon to press the skate blade 40 into engagement with the fixed stone 25; the stones 25 may be biased toward the sharpening configuration by a spring as long as the stones 25 are provided with a suitable camming surface to urge them apart in response to insertion of the skate blade 40; less preferably, a single stone 25 might be used and the skate blade 40 reversed for sharpening its opposite face; and, the housing can be comprised of two identical halves with a spring for holding them together, as taught in U.S. Pat. No. 4,392,674.

The above-described embodiments of the invention are intended in an illustrative rather than a restrictive sense and alterations and modifications may be effected thereto, by those of skill in the art, without departing from the spirit and scope of the invention which is defined solely by the claims appended hereto.

We claim:

1. An ice skate guard having a housing;

a parallel sided channel extending along said housing for receiving a skate blade, said channel having a width and a length corresponding respectively to a thickness and a length of said skate blade for receiving and protecting said skate blade and enabling a user to walk on said guard; and a sharpener mounted to said housing and extending into said channel for engaging said skate blade as said skate blade is drawn through said channel.

2. The ice skate guard of claim 1, wherein said sharpener comprises opposing stones.

3. The ice skate guard of claim 2, wherein said sharpener comprises an actuator operably connected to at least one of said stones for urging said stones against said skate blade.

4. The sharpener of claim 3, wherein said stones are honing stones.

5. The ice skate guard of claim 1, wherein said ice skate guard is formed of molded plastic material.

6. The ice skate guard of claim 3, wherein said actuator is accessible from the exterior of said ice skate guard.

7. The ice skate guard of claim 6, wherein said actuator comprises at least one push button.

8. The ice skate guard of claim 6, wherein said actuator comprises opposing push buttons.

9. The ice skate guard of claim 3, wherein said sharpener further comprises a resilient biasing means connected to said stones and said housing for moving said stones into a non-sharpening sharpening position.

10. The ice skate guard of claim 9, wherein said resilient biasing means acts between said housing and said actuator.

11. The ice skate guard of claim 9, wherein said resilient biasing means is at least one spring.

12. The ice skate guard of claim 10, wherein said resilient biasing means is at least one spring.

13. The ice skate guard of claim 9, wherein said resilient biasing means is two opposing springs.

14. The ice skate guard of claim 10, wherein said resilient biasing means is two opposing springs.

15. The ice skate guard of claim 12, wherein said spring is a SAE 1050gr spring steel clip.

16. The ice skate guard of claim 14, wherein said spring is a SAE 1050gr spring steel clip.

* * * * *